US008388096B2

(12) United States Patent
Chee et al.

(10) Patent No.: US 8,388,096 B2
(45) Date of Patent: Mar. 5, 2013

(54) DETECTING AND REMOVING FIBERS

(75) Inventors: Chin Lee Chee, Singapore (SG); Chiok Liang Tay, Singapore (SG); William Choo, Singapore (SG); Yew Khew Lan Chow Wing, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 378 days.

(21) Appl. No.: 12/641,084

(22) Filed: Dec. 17, 2009

(65) Prior Publication Data

US 2011/0148981 A1 Jun. 23, 2011

(51) Int. Cl.
*B41J 29/393* (2006.01)

(52) U.S. Cl. ..... 347/19

(58) Field of Classification Search ..... None
See application file for complete search history.

(56) References Cited

U.S. PATENT DOCUMENTS

| | | | | |
|---|---|---|---|---|
| 6,984,018 | B2 | 1/2006 | Uetsuki et al. | |
| 7,118,190 | B2 | 10/2006 | Sakamoto et al. | |
| 7,182,424 | B2 | 2/2007 | Kubota | |
| 7,300,131 | B2 | 11/2007 | Sakagami et al. | |
| 2005/0264602 | A1 | 12/2005 | Mizuno | |
| 2006/0256153 | A1 | 11/2006 | Arakawa | |
| 2008/0094445 | A1 * | 4/2008 | Silverbrook et al. | 347/29 |
| 2008/0225072 | A1 | 9/2008 | Klees et al. | |
| 2008/0252682 | A1 | 10/2008 | Hernandez et al. | |
| 2009/0109258 | A1 * | 4/2009 | Nitta et al. | 347/33 |
| 2009/0189933 | A1 * | 7/2009 | Nakano | 347/9 |

* cited by examiner

*Primary Examiner* — Matthew Luu
*Assistant Examiner* — Justin Seo
(74) *Attorney, Agent, or Firm* — Garry A. Perry

(57) ABSTRACT

In one embodiment, a method to detect and remove fibers comprises identifying blocked nozzles in a grouping of nozzles within a printhead, and triggering a fiber removal event if it is determined that a plurality of adjacent nozzles are blocked.

20 Claims, 6 Drawing Sheets

DETECTING AND REMOVING FIBERS

BACKGROUND

Printing may be achieved by a broad variety of methods. One method is to utilize a nozzle-carrying printhead, whereby the nozzles eject drops of ink onto a media to form images on the media. Nozzles in a printhead can become faulty for a number of reasons, including being blocked by dried ink, media fibers and other debris. Faulty nozzles in a printhead may negatively impact the quality and the speed of printing.

BRIEF DESCRIPTION OF THE DRAWINGS

The accompanying drawings illustrate various embodiments and are a part of the specification. The illustrated embodiments are merely examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

Blocked nozzles due to bubbles, dried ink, or particles lodged internally in a printhead can often be resolved by regular priming servicing, including force-spitting new ink to clear the nozzle. However for paper and other media fibers sticking externally on the nozzle plate and blocking nozzles, priming servicing frequently is not effective as fibers tend to stick more stubbornly on the nozzle plate. Utilizing priming servicing to try to remove fibers in such circumstances can waste ink and time.

Other regular servicing routines, such as wiping, may resolve fibers that block nozzles, but such routines can prove ineffective in remedying other causes of nozzle blockage (e.g. bubbles or debris lodged internally in a printhead). Without good information that it is a fiber that is blocking nozzles (as opposed to bubbles, dried ink, etc.), initiating a regular wiping routine or routines in an effort to remedy nozzle blockages may cause unnecessary delay and expense.

Another approach to the issue of blocked nozzles is to use nozzle health information gathered from a drop detector or other sensor to implement error-hiding techniques during printing. These techniques are designed to utilize multiple passes or combinations of nozzles to compensate for faulty nozzles, and thereby maintain good print quality. Such error hiding can be effective for nozzles blocked due to bubbles, dried ink, or particles lodged internally in a printhead. Such error hiding may not be effective for fibers sticking to the surface of a printhead, however, as fibers move and the nozzle health information cannot not keep up to pace with the changed locations of the blocked nozzles. Hence, in these circumstances an error-hiding routine may not correctly compensate for the newly blocked nozzles. This may result in significant image quality and speed issues.

Embodiments described below were developed in an effort to detect and remove fibers that block printhead nozzles, thereby improving printing quality and speed and reducing expense. The embodiments shown in the accompanying drawings and described below are non-limiting examples. Other embodiments are possible and nothing in the accompanying drawings or in this Detailed Description of Embodiments should be construed to limit the scope of the disclosure, which is defined in the Claims.

The following description is broken into sections. The first, labeled "Environment", describes an exemplary environment in which embodiments may be implemented. The second section, labeled "Components", describes various physical and logical components utilized to implement various embodiments. The third section, labeled as "Operation", describes exemplary embodiments of a method to restrict printing to a media source. The third section, labeled "Example", describes an example in which fibers are identified for removal from printhead nozzles according to an embodiment.

ENVIRONMENT

Figure 1:
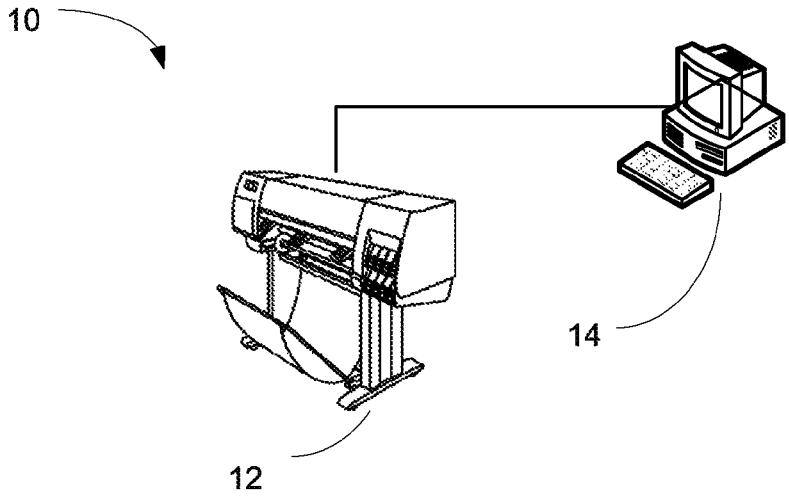
FIG. 1 depicts an exemplary environment in which various embodiments may be implemented.

FIG. 1 depicts an exemplary environment 10 in which various embodiments may be implemented. Environment 10 is shown to include printing system 12. Printing system 12 represents generally an assembly of components configured to produce printed images of media. Printing system 12, for example, may be used for printing photographs, forms, advertisements, coupons and the like. Host 14 represents generally any computing device capable of communicating print jobs to print system 12. Host 14 may also supply a user interface allowing a user to obtain status information and to configure printing system 12. In an embodiment, printing system 12 may operate in conjunction with one or more host computing devices capable of communicating print jobs to printing system 12. In an embodiment, printing system 12 connects directly or indirectly with a host 14. In an embodiment printing system 12 connects to a host via a cable or wireless or other means in a manner such that printing system 12 may receive instructions and print jobs from host 14. In another embodiment, printing system 12 may connect directly to one or more hosts 14 via the Internet. In an embodiment printing system 12 may operate in a standalone mode without being connected to host 14, the printing system 12 being configured to receive print jobs via the Internet, email or an external memory device.

Figure 2:
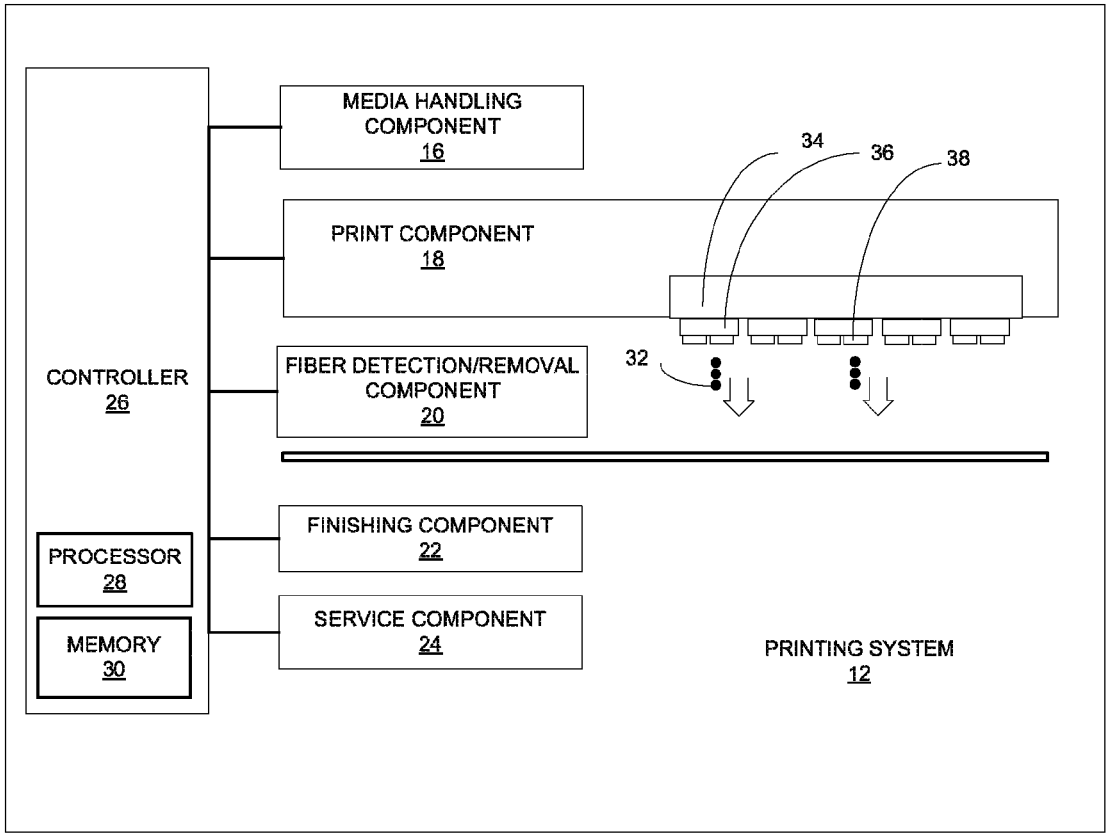
FIG. 2 depicts an exemplary diagram depicting the physical and logical components of a printing system according to an embodiment.

FIG. 2 is an exemplary block diagram of printing system 12. In this example, printing system 12 is shown to include a media handling component 16, a print component 18, a fiber detection/removal component 20, a finishing component 22, a service component 24, and a controller 26. Media handling component 16 represents generally any combination of hardware and programming capable of transporting media through the printing system 12. Finishing component 24 represents generally any combination of hardware and programming capable of performing a finishing operation on media. Such finishing operations include cutting, folding, laminating or any other action that affects the physical nature of the print medium.

Print component 18 represents generally any combination of elements capable of being utilized to form desired images on media. Media may include sheets, a continuous roll or web, or any other media on which a print image can be formed. In a given example, print component 18 may include a fluid ejection mechanism 34, each fluid ejection mechanism 34 including multiple printheads 36 configured to dispense ink 32 or other fluid. As used in this specification and the appended claims, "printhead" includes a mechanism having a plurality of nozzles through which ink or other fluid is ejected. Examples of printheads are drop-on-demand inkjet printheads, thermo resistive printheads, piezo and resistive printheads. Some printheads may be part of a cartridge which also stores the fluid to be dispensed. Other printheads are standalone and are supplied with fluid by an off-axis ink supply. In an embodiment, service component 24 represents generally any combination of elements capable of being utilized to service print component 18 for issues other than fiber detection and removal. Where, for example, print component 18 includes a printhead 36, service component 24 may be configured to function as a spittoon and color and alignment calibrator.

Figure 3:
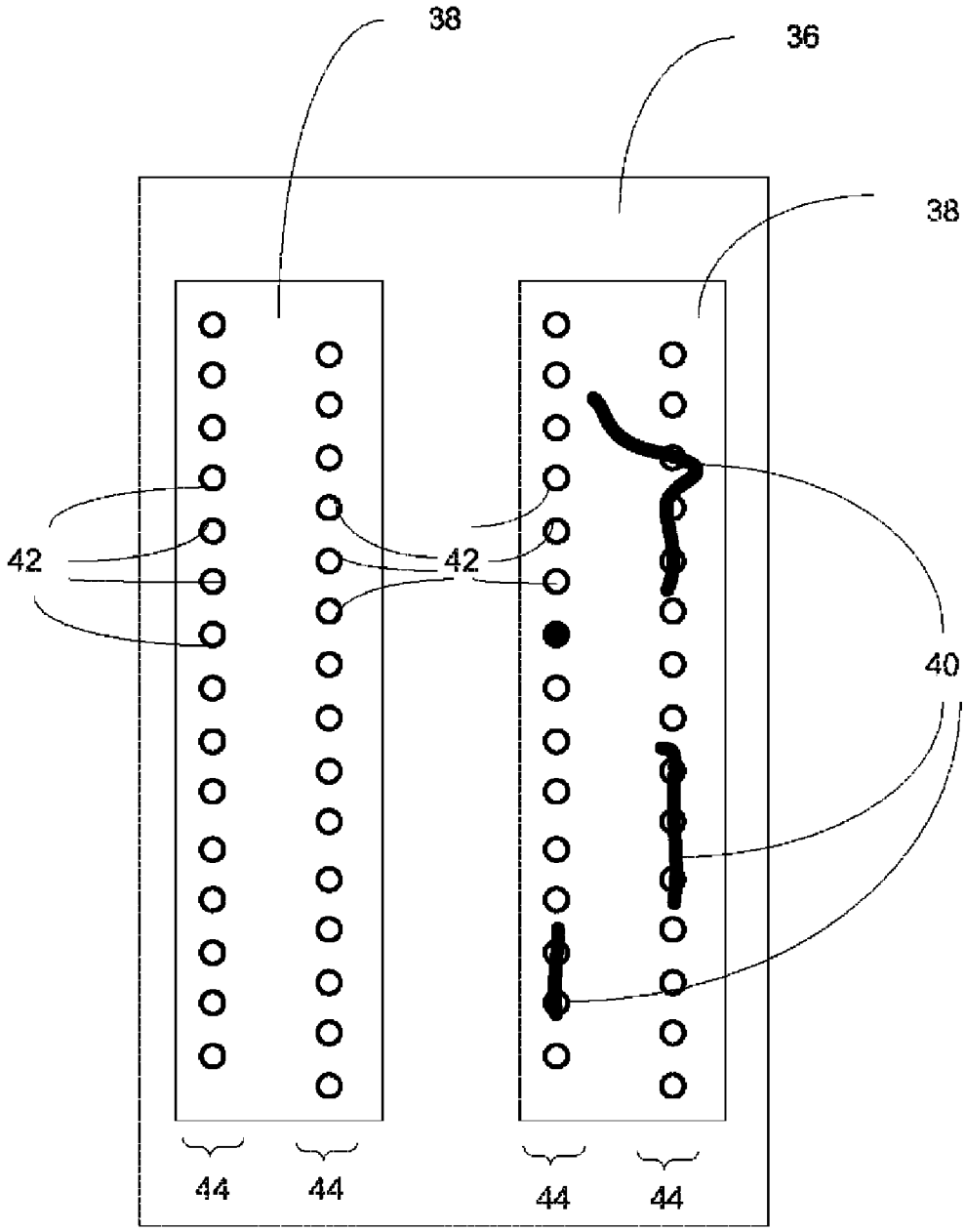
FIG. 3 depicts an exemplary printhead with including multiple nozzles according to an embodiment.

FIG. 3 depicts a bottom up view of an exemplary printhead 36 including multiple nozzles 42 according to an embodiment. "Printhead nozzle" and "nozzle" are referred to synonymously throughout this application. As used in this specification and the appended claims, "nozzle" includes an opening from which fluid may be discharged. In this example the printhead includes two printhead dies 38, and each printhead die 38 includes a plurality of printhead nozzles 42 organized into two columns 44 and a larger number of rows. Each of the dies is capable of ejecting ink 32 or other fluid therefrom via a number of nozzles organized over the two columns 44. The die on the left in FIG. 3 has no fibers blocking nozzles. The die on the right in FIG. 3 shows three fibers 40 sticking to the outside surface of the die 38, the three fibers 40 blocking a total of eight nozzles. The arrangement of nozzles illustrated in FIG. 3 is illustrative and other embodiments are possible. In one embodiment of a printhead, there are two die each with 528 nozzles arranged in two columns, such that there are 1,056 nozzles per each die, and thus 2,112 nozzles per each of the printheads. Other embodiments might include different numbers of nozzles, different numbers of columns, and/or different arrangements of nozzles. In embodiments, printheads may contain three, four, five or more than five printhead dies, with each die including multiple nozzles. In an embodiment, a printhead may include a plurality of nozzles that are not a part of a printhead die.

Returning to FIG. 2, and discussed in more detail below with reference to FIGS. 3 and 4, fiber detection/removal component 20 represents generally any programming, that, when executed, implements the functionality of the fiber service module 46 of FIG. 4. In particular, fiber detection/removal component 20, when executed by controller 26, is responsible for receiving information from a sensing device and identifying blocked nozzles in a grouping of nozzles 42 within a printhead 36, and triggering a fiber removal event if it is determined that a plurality of adjacent nozzles 42 are blocked. As used in this specification and the appended claims, "grouping" includes, but is not limited to, grouping according to printhead die, grouping according to physical location in a printhead or die, and/or grouping according to columns of nozzles within a printhead die. As used in this specification and the appended claims, "adjacent nozzles" includes two or more nozzles that are next to each other.

In an embodiment, the fiber detection/removal component 20 is responsible for triggering a fiber removal event if it is determined that a plurality of adjacent nozzles 42 in a column of nozzles 42 in a printhead die 38 are blocked. In an embodiment, the fiber detection/removal component 20 is responsible for triggering a fiber removal event if it is determined that two or more adjacent nozzles 42 are blocked. In an embodiment, the fiber detection/removal component 20 is responsible for triggering a fiber removal event if it is determined that three or more adjacent nozzles 42 are blocked. In an embodiment, the fiber detection/removal component 20 incorporates a sensing device, and is responsible for receiving information from the sensing device and identifying blocked nozzles 42 in a grouping of nozzles 42 within a printhead 36. In an embodiment, the sensing device includes a drop detector. In an embodiment, the sensing device includes a drop detector that is or includes an electrostatic drop detector. In an embodiment, the fiber detection/removal component 20 evaluates a plurality of nozzles 42 for blockage one nozzle 42 at a time.

Printing system 12 is shown to include a controller 26. As used in this specification, controller 26 represents generally any combination of elements capable of coordinating the operation of components 16 to 24. In a given implementation, the controller 26 includes a processor 28 and a memory 30. The processor 28 may represent multiple processors, and the memory 30 may represent multiple memories. In an embodiment, the controller 26 may include a number of software components that are stored in a computer-readable medium, such as memory 30, and are executable by processor 28. In this respect, the term "executable" includes a program file that is in a form that can be directly (e.g. machine code) or indirectly (e.g. source code that is to be compiled) performed by the processor 28. An executable program may be stored in any portion or component of memory 30.

COMPONENTS

Figure 4:
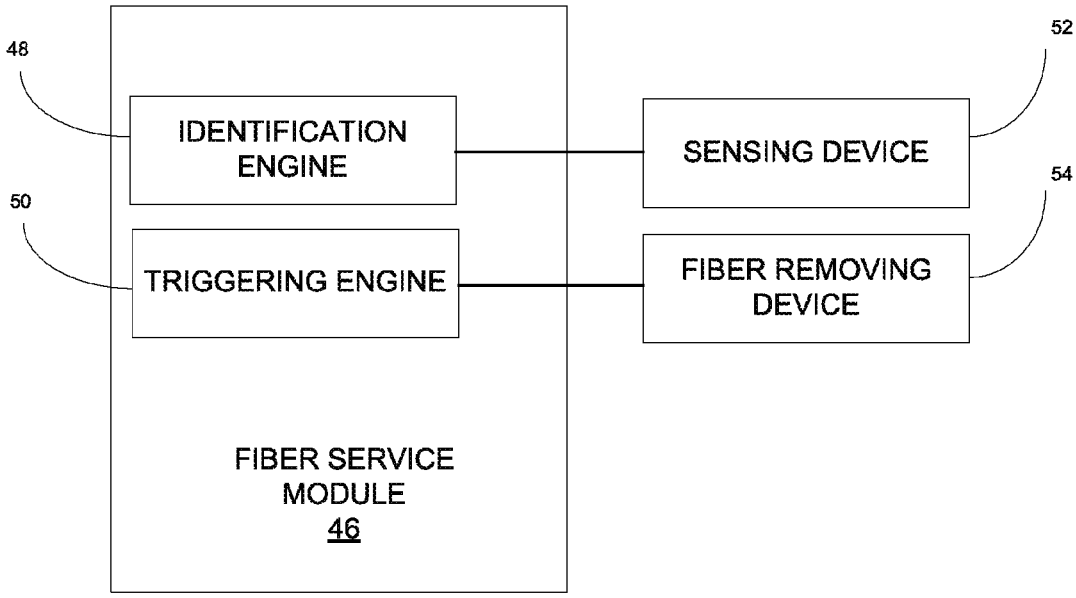
FIG. 4 depicts an exemplary fiber service module according to an embodiment.

FIG. 4 is an exemplary block diagram illustrating the physical and logical components of a fiber service module 46. Fiber service module 46 represents generally any combination of hardware and programming configured for use to detect and remove fibers that block printhead nozzles. In the example of FIG. 4, fiber service module 46 is shown to include an identification engine 48 and a triggering engine 50.

Identification engine 48 represents generally any combination of hardware and programming configured to receive information from a sensing device 52 and identify blocked nozzles in a grouping of nozzles within a printhead. In an embodiment the identification engine 48 is operable to evaluate a plurality of nozzles for blockage one nozzle at a time.

In an embodiment, identification engine 48 connects to a sensing device 52, and the identification engine 48 is operable to receive information from the sensing device 52 and identify blocked nozzles in a grouping of nozzles within a printhead. In an embodiment the sensing device 52 includes a drop detector. As used in this specification and the appended claims, "drop detector" includes a device that is operable to detect the presence or size or quantity of drops of ink or other liquid. In an embodiment, the drop detector may employ piezo-electric material and associated circuitry which detects the impact of the ink drops hitting the detection station and thereby detect the ejection of ink drops from a printhead. In an embodiment, the drop detector may be an optical detector that includes a light source and a light detector. An inkjet nozzle may be aimed so that the ink drops pass between the light source and the light detector and occlude light rays that travel between the light source and the detector. In an embodiment, the drop detector may be an acoustic drop detector. In an embodiment, the drop detector includes a sensing element which is imparted with an electrical stimuli when struck by each ink drop in a series of ink drop bursts to be ejected from the printhead.

In an embodiment, the drop detector is an electrostatic drop detector. An electrostatic drop detector may include an entrance slot, a charge plate, a vertically-positioned electrostatic sensor that detects the ink drops and characteristics of the ink drops as the drops make their way past the sensor and an amplifier. In an example, the electrostatic drop detector may be configured to be positioned over a printhead. The electrostatic drop detector may be configured such that as the printhead fires ink drops, a charge plate at the top of the sensor assembly induces an electrostatic charge in the drops. In an embodiment the charging may take place just before the drops break free from the printhead. The vertically-positioned electrostatic sensor may be configured such that charged drops flying past the sensor induce an electrical charge on the sensor. The electrostatic drop detector may be configured to use the signal, which corresponds to the charge of the ink drops, to determine the condition of the print nozzles—healthy or missing. In an embodiment, the drop detector does not detect a signal if a nozzle is missing and no ink drops are fired, indicating a nozzle out. The electrostatic drop detector may be configured to pass nozzle health information to the identification engine 48.

Triggering engine 50 represents generally any combination of hardware and programming configured to trigger a fiber removal event if it is determined that a plurality of adjacent nozzles are blocked. In an embodiment, the triggering engine 50 may be configured to trigger a fiber removal event if it is determined that a plurality of adjacent nozzles in a column of nozzles in a printhead die are blocked. In an embodiment, the triggering engine 50 may trigger a fiber removal event if it is determined that two or more adjacent nozzles are blocked. In an embodiment, the triggering engine 50 may trigger a fiber removal event if it is determined that three or more adjacent nozzles are blocked. As used in this specification and the appended claims, "fiber removal event" includes a servicing event to remove a fiber from a printhead or printhead nozzles.

In an embodiment, triggering engine 50 connects to a fiber removing device 54. In an embodiment the fiber removing device 54 may include a wiper arm, such that when the fiber removing device 54 receives a signal from the triggering engine 50, a wiper arm extends to wipe the printhead and printhead die to remove a fiber that is blocking nozzles. In an embodiment, the wiper arm retracts away from the printhead after a wiping operation. In an embodiment the printheads are configured to move away from the wiper arm after a wiping operation. In an embodiment the extension and retraction of the wiper arm may be actuated by movement of a service station shuttle. In an embodiment, the fiber removing device 54 may remove fibers by use of positive or negative air pressure. In an embodiment, the fiber removing device 54 may include a web of woven or non-woven flexible wiping material, configured to be brought in to contact with and/or pressed against nozzles of a printhead to remove fibers.

The fiber service module 46 may be implemented in a number of environments, such as environment 10 of FIG. 1.

OPERATION

Figure 5:
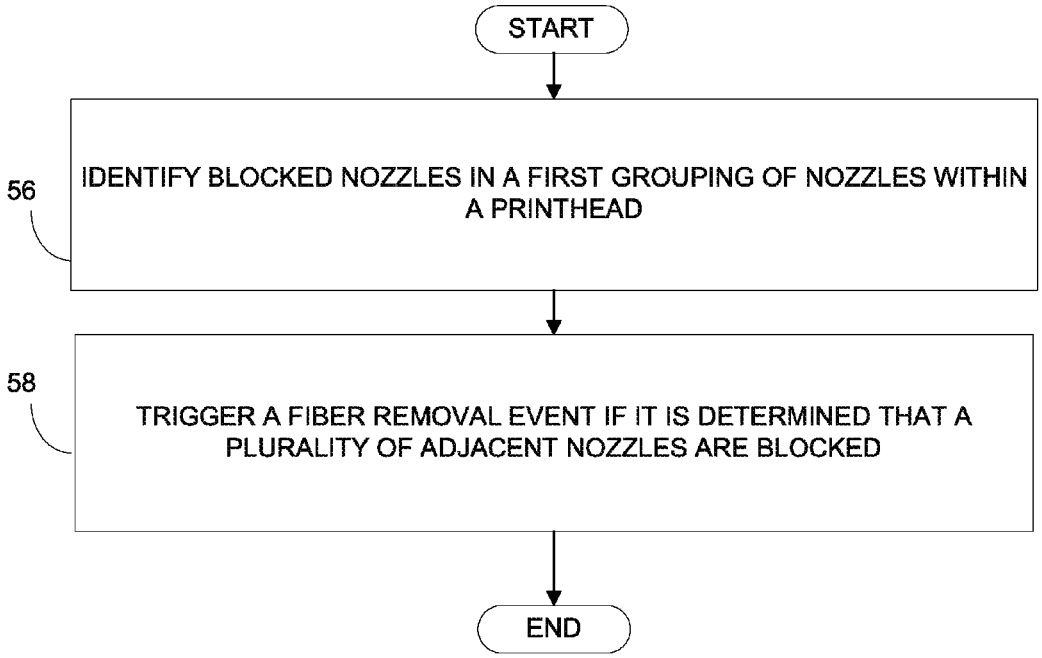
FIGS. 5-6 are exemplary flow diagrams depicting embodiments of a method to detect and remove fibers.
Figure 6:
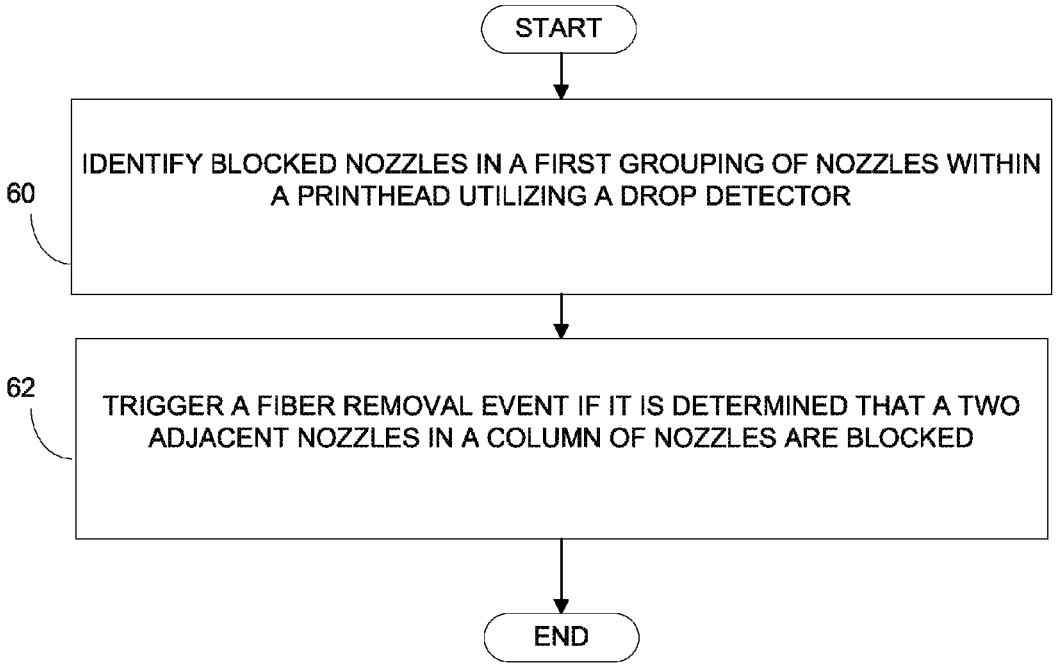

FIGS. 5-6 are exemplary flow diagrams depicting exemplary embodiments of a method to detect and remove fibers that block printhead nozzles. In discussing FIGS. 5-6, reference may be made to the diagrams of FIGS. 1-4 to provide contextual examples. Implementation, however, is not limited to those examples.

Starting with FIG. 5, blocked nozzles in a grouping of nozzles within a printhead are identified (block 56). Referring back to FIG. 4, the identification engine 48 may be responsible for implementing block 48. In an embodiment, the information regarding blocked and unblocked nozzles is received from a sensing device. In an embodiment, the identifying of blocked nozzles includes evaluating nozzles for blockage one nozzle at a time Continuing with the flow diagram of FIG. 5, a fiber removal event is triggered if it is determined that a plurality of adjacent nozzles are blocked (block 58). Referring back to FIG. 4, the triggering engine 50 may be responsible for implementing block 50. In an embodiment, a fiber removal event is triggered if two or more adjacent nozzles are blocked. In an embodiment, a fiber removal event is triggered if three or more adjacent nozzles are blocked. In an embodiment, a fiber removal event is triggered if four or more adjacent nozzles are blocked. In an embodiment, a fiber removal event is triggered if five or more adjacent nozzles are blocked. In an embodiment, a fiber removal event is triggered if six or more adjacent nozzles are blocked. In an embodiment, the fiber removal event includes extending a wiping arm to wipe the printhead and printhead die to remove a fiber that is blocking nozzles.

Moving on to FIG. 6, in a particular implementation, blocked nozzles in a grouping of nozzles within a printhead are identified utilizing a drop detector (block 60). Referring back to FIG. 4, the identification engine 48 may be responsible for implementing block 60. In an embodiment, the information regarding blocked and unblocked nozzles is received from a drop detector that employs piezo-electric material and associated circuitry to detect the ejection of ink drops from a printhead. In an embodiment, the information regarding blocked and unblocked nozzles is received from an optical drop detector. In an embodiment, the information regarding blocked and unblocked nozzles is received from an acoustic drop detector. In an embodiment, the information regarding blocked and unblocked nozzles is received from an electrostatic drop detector.

Continuing with the flow diagram of FIG. 6, a fiber removal event is triggered if it is determined that two or more adjacent nozzles are blocked (block 62). Referring back to FIG. 4, triggering engine 50 may be responsible for implementing block 62. In an embodiment, a fiber removal event is triggered if it is determined that two or more adjacent nozzles in a column of nozzles in a printhead die are blocked (block 62). In an embodiment, the fiber removal event includes bringing a web or length of flexible wiping material into contact with and/or to press against nozzles of a printhead to remove fibers.

EXAMPLE

Figure 7:
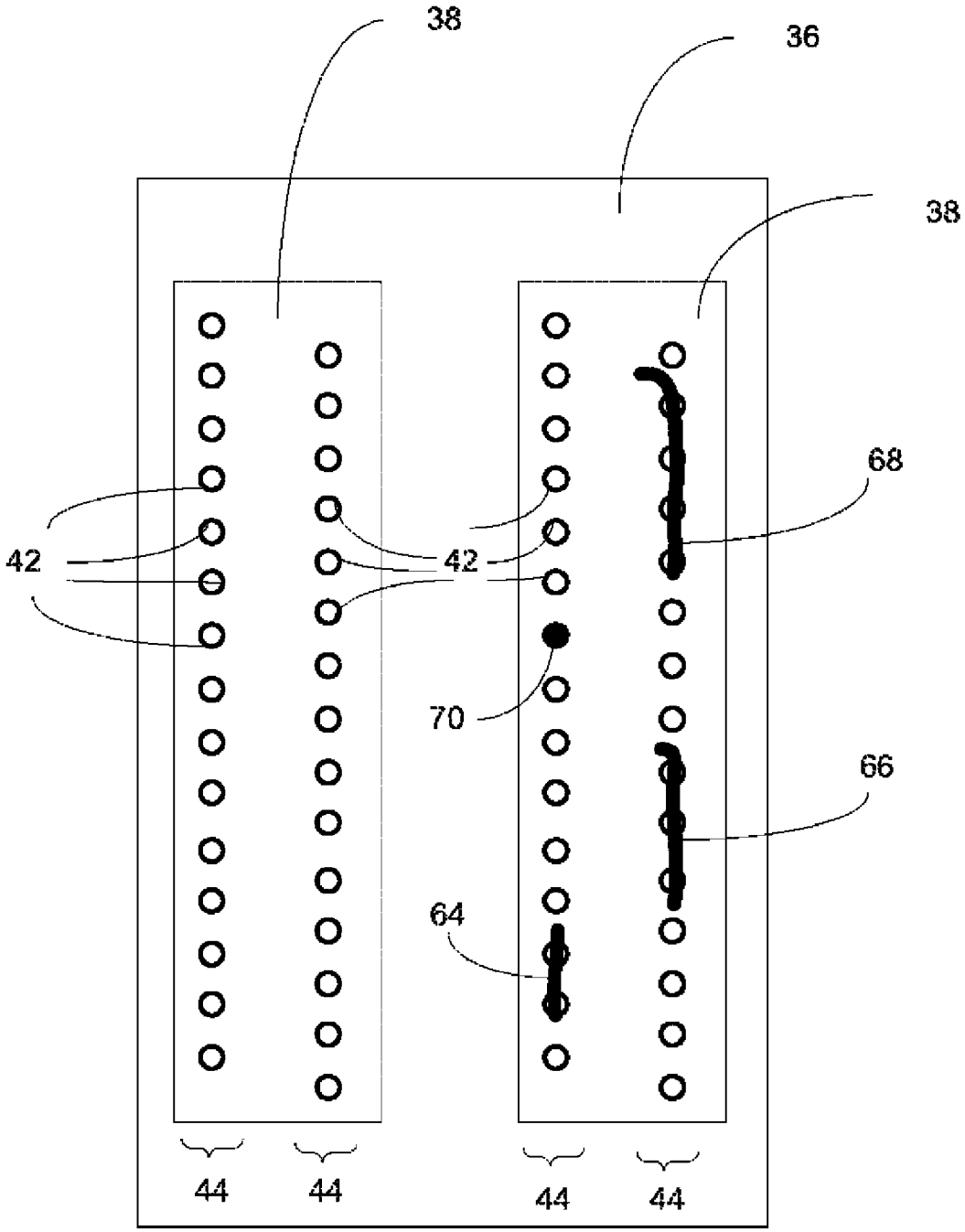
FIG. 7 depicts an example in which fibers are identified for removal from printhead nozzles according to an embodiment.

The diagram of FIG. 7 is used to depict an example in which fibers are identified for removal from printhead nozzles according to an embodiment. FIG. 7 depicts a close up view of an exemplary printhead 36 that includes two representative printhead dies 38. Each of the two dies 38 includes a plurality of nozzles 42 organized into two columns 44 and a larger number of rows. Each of the dies 38 is capable of ejecting ink or other fluid therefrom via a number of nozzles 42 organized over the two columns 44. The die 38 on the left in FIG. 7 has no fibers blocking nozzles. The die on the right in FIG. 7 shows three fibers sticking to the outside surface of the die 38, the three fibers blocking a total of nine nozzles.

In an embodiment, the identification engine 48 (FIG. 4) evaluates a grouping of nozzles within a printhead to identify blocked nozzles. In an embodiment the grouping constitutes those nozzles contained in a printhead die. In an embodiment, the triggering engine 50 (FIG. 4) triggers a fiber removal event if it is determined that two or more adjacent nozzles in the grouping of nozzles are blocked. In such an embodiment obstruction 64, obstruction 66 and obstruction 68 that are blocking nozzles are recognized as fibers and a fiber removal event is initiated because two or more adjacent nozzles are blocked. Obstruction 70 that blocks one nozzle is not recognized as a fiber as two or more adjacent nozzles are not blocked. If obstruction 70 that blocks one nozzle was the only obstruction blocking nozzles on the printhead, no fiber removal event would be triggered as two or more adjacent nozzles in the grouping are not blocked.

In an embodiment, the triggering engine triggers a fiber removal event if it is determined that three or more adjacent nozzles in the grouping of nozzles are blocked. In such an embodiment obstruction 66 and obstruction 68 that are blocking nozzles are all recognized as fibers and a fiber removal event is initiated because three or more adjacent nozzles are blocked. Obstruction 62 that blocks one nozzle and obstruction 64 that blocks two adjacent nozzles are not recognized as fibers as three or more adjacent nozzles are not blocked. If obstruction 70 that blocks one nozzle and obstruction 64 that blocks two adjacent nozzles were the only obstructions blocking nozzles in the grouping of nozzles, no fiber removal event would be triggered as three or more adjacent nozzles are not blocked.

CONCLUSION

The diagrams of FIGS. 1-3 are used to depict exemplary environments in which various embodiments may be implemented. Implementation, however, is not so limited. FIG. 4 shows the architecture, functionality, and operation of various embodiments. Various components illustrated in FIGS. 2-4 are defined at least in part as programs. Each such component, portion thereof, or various combinations thereof may represent in whole or in part a module, segment, or portion of code that comprises one or more executable instructions to implement any specified logical function(s). Each component or various combinations thereof may represent a circuit or a number of interconnected circuits to implement the specified logical function(s).

Also, the present disclosure may be embodied in any computer-readable media for use by or in connection with an instruction execution system such as a computer/processor based system or an ASIC (Application Specific Integrated Circuit) or other system that can fetch or obtain the logic from computer-readable media and execute the instructions contained therein. "Computer-readable media" can be any media that can contain, store, or maintain programs and data for use by or in connection with the instruction execution system. Computer readable media can comprise any one of many physical media such as, for example, electronic, magnetic, optical, electromagnetic, or semiconductor media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc.

Although the flow diagrams of FIGS. 5-6 show specific orders of execution, the order of execution may differ from that which is depicted. For example, the order of execution of two or more blocks may be scrambled relative to the order shown. Also, two or more blocks shown in succession may be executed concurrently or with partial concurrence. All such variations are within the scope of the present disclosure.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A method to detect and remove fibers, comprising:

identifying a fiber on a printhead by sensing that a plurality of adjacent nozzles of the printhead are blocked; and triggering a fiber removal event comprising wiping the printhead if it is determined that the fiber is on the printhead.

2. The method of claim 1, wherein the plurality of adjacent nozzles comprises a plurality of adjacent nozzles in a column of nozzles in a printhead die.

3. The method of claim 1, wherein the plurality of adjacent nozzles comprises two or more adjacent nozzles.

4. The method of claim 1, wherein the plurality of adjacent nozzles comprises three or more adjacent nozzles.

5. The method of claim 1, wherein identifying the fiber on the printhead comprises identifying blocked nozzles utilizing a drop detector.

6. The method of claim 5, wherein identifying the fiber on the printhead comprises identifying blocked nozzles utilizing an electrostatic drop detector.

7. The method of claim 1, wherein identifying the fiber on the printhead comprises evaluating a plurality of nozzles for blockage one nozzle at a time.

8. A non-transitory machine-readable medium storing computer executable instructions executable by a processor to:

identify a fiber on a printhead by sensing that a plurality of adjacent nozzles of the printhead are blocked; and trigger a fiber removal event comprising wiping the printhead if it is determined that the fiber is on the printhead.

9. The medium of claim 8, wherein the plurality of adjacent nozzles comprises a plurality of adjacent nozzles in a column of nozzles in a printhead die.

10. The medium of claim 8, wherein the plurality of adjacent nozzles comprises two or more adjacent nozzles.

11. The medium of claim 8, wherein the plurality of adjacent nozzles comprises three or more adjacent nozzles.

12. The medium of claim 8, wherein the fiber removal event includes extending a wiper arm to wipe the blocked adjacent nozzles.

13. The medium of claim 12, wherein the fiber removal event includes bringing a web of woven or non-woven flexible wiping material into contact with the blocked adjacent nozzles.

14. A system to detect and remove fibers, comprising:

an identification engine, operable to receive information from a sensing device and identify a fiber on a printhead by sensing that a plurality of adjacent nozzles of the printhead are blocked; and a triggering engine, operable to trigger a fiber removal event comprising wiping the printhead if it is determined that the fiber is on the printhead.

15. The system of claim 14, wherein the triggering engine is operable to trigger the fiber removal event if it is determined that a plurality of adjacent nozzles in a column of nozzles in a printhead die are blocked.

16. The system of claim 14, wherein the triggering engine is operable to trigger the fiber removal event if it is determined that two or more adjacent nozzles are blocked.

17. The system of claim 14, further comprising a sensing device and wherein the identification engine is operable to receive information from the sensing device and identify blocked nozzles in a grouping of nozzles within a printhead.

18. The system of claim 14, wherein the fiber removal event includes extending a wiper arm to wipe the printhead.

19. The system of claim 14, wherein the fiber removal event includes bringing a web of woven or non-woven flexible wiping material into contact with the printhead.

20. The system of claim 14, wherein the identification engine is operable to evaluate a plurality of nozzles for blockage one nozzle at a time.

* * * * *